US007165980B2

(12) United States Patent
Pyron et al.

(10) Patent No.: US 7,165,980 B2
(45) Date of Patent: Jan. 23, 2007

(54) CONDUIT BUSHING WITH REVOLVING LUG

(75) Inventors: Roger D. Pyron, Barlett, TN (US); David W. Fraze, Jonesboro, AR (US)

(73) Assignee: Thomas & Betts International, Inc., Wilmington, DE (US)

( * ) Notice: Subject to any disclaimer, the term of this patent is extended or adjusted under 35 U.S.C. 154(b) by 10 days.

(21) Appl. No.: 11/093,106

(22) Filed: Mar. 29, 2005

(65) Prior Publication Data

US 2005/0255728 A1 Nov. 17, 2005

Related U.S. Application Data

(60) Provisional application No. 60/570,772, filed on May 13, 2004.

(51) Int. Cl.
*H01R 4/66* (2006.01)

(52) U.S. Cl. ..... 439/100; 439/534

(58) Field of Classification Search ..... 439/100, 439/98, 101, 99, 534; 174/78
See application file for complete search history.

(56) References Cited

U.S. PATENT DOCUMENTS

| | | | | |
|---|---|---|---|---|
| 1,941,905 | A | | 1/1934 | Mair |
| 2,260,136 | A | | 10/1941 | Bergan |
| 2,710,381 | A | | 6/1955 | Monson |
| 2,974,185 | A | | 3/1961 | Curtiss |
| 3,027,533 | A | | 3/1962 | Monson |
| 3,365,693 | A | | 1/1968 | Browne |
| 3,492,625 | A | | 1/1970 | Bromberg |
| 3,967,872 | A | | 7/1976 | Mooney et al. |
| 4,159,859 | A | | 7/1979 | Shemtov |
| 4,372,565 | A | * | 2/1983 | Lien ..... 277/614 |
| 4,806,108 | A | | 2/1989 | Meinhardt |
| 4,875,864 | A | | 10/1989 | Campbell |
| 5,006,074 | A | | 4/1991 | Franks, Jr. |
| 5,295,866 | A | * | 3/1994 | Kroger et al. ..... 439/589 |
| 5,929,383 | A | * | 7/1999 | Marik et al. ..... 174/78 |
| 5,996,695 | A | * | 12/1999 | Koleilat et al. ..... 166/382 |

* cited by examiner

*Primary Examiner*—Phuong Dinh
(74) *Attorney, Agent, or Firm*—Hoffmann & Baron, LLP

(57) ABSTRACT

A grounding device for an electrical conduit which includes: a bushing having an outer wall and a notch in the outer wall; a lug rotatably accommodated by the notch; and a grounding connector with a set screw which is attached to the lug. The grounding conductor is electrically contacted to the bushing by the set screw. In addition, the force exerted by the set screw frictionally engages the lug with the bushing and locks the lug in place so that the lug is no longer free to rotate. The grounding connector can be reoriented by loosening the set screw and rotating the lug to a different orientation.

13 Claims, 3 Drawing Sheets

CONDUIT BUSHING WITH REVOLVING LUG

This application claims priority from provisional application Ser. No. 60/570,772, filed on May 13, 2004.

FIELD OF THE INVENTION

The present invention relates to a grounding device for metal conduits. In particular, the invention relates to a conduit bushing with an adjustable grounding lug.

BACKGROUND OF INVENTION

Various electrical codes require the installation of a secondary grounding conductor between electrical conduits and metal enclosures. These grounding requirements are set forth in Section 250 of the National Electrical Code ("NEC"), which requires the effective grounding path to be permanent and electrically continuous. To comply with the codes, various grounding devices have been attached to the fittings that connect conduits to electrical enclosures. Examples of such devices are found in U.S. Pat. No. 2,974,185 to Curtiss and U.S. Pat. No. 3,492,625 to Bromberg, both of which disclose grounding connections attached to conduit bushings and both of which are incorporated herein in their entirety.

Several of the grounding devices currently being used are designed with a grounding connection permanently attached to a bushing at one or more predetermined locations. In these devices, the grounding lugs are mounted to the bushing via a tapped hole and bolt. The electrician would be limited to mounting locations by the number of tapped holes around the perimeter of the bushing (usually 2 or 3, see U.S. Pat. No. 3,492,625). Although these devices are functional in design, they often present installation problems for the user. Specifically, when the grounding connection is permanently attached to the bushing, the installer cannot control the final angular position of the grounding connection relative to the conduit once the bushing is tightened. Thus, the grounding connection may not be positioned at an accessible location after the bushing is tightened. The user must, therefore, overtighten or undertighten the gland nut to locate the grounding connection at a suitable angular position. As will be appreciated by those skilled in the art, overtightening or undertightening may affect the integrity of the seal between the conduit and the wall of the enclosure. The location of the grounding connection on the bushing may also make tightening the bushing difficult and/or infeasible in applications where the space is restricted.

There is, therefore, a need for a bushing with a grounding connection which can be oriented over 360 degrees and which does not interfere with the tightening of the bushing. There is also a need for a bushing with a grounding connection which can be easily installed in enclosures with limited room for tightening the bushing.

SUMMARY OF THE INVENTION

In accordance with the present invention, a grounding device for an electrical conduit is provided. The grounding device includes a bushing having a lug rotatably mounted in a notch in the outer wall of the bushing or on a ring on the outer wall and a grounding connector with a set screw or clamp attached to the lug. A grounding conductor is inserted into the connector and secured in place between the connector and the bushing by the set screw or clamp. The force exerted by tightening the set screw or clamp frictionally engages the lug with the bushing and locks it in place so that it is no longer free to rotate. If it becomes necessary to reorient the grounding connector, the set screw or clamp is loosened and the lug is free to rotate to a different orientation.

A preferred embodiment of the grounding device of the present invention includes: a bushing having an outer wall and a notch in the outer wall or a ring on the outer wall; a lug rotatably accommodated by the notch or ring; and a grounding connector attached to the lug which preferably includes a set screw or clamp. The grounding conductor is electrically contacted to the bushing by the set screw or clamp. In addition, the force exerted by the set screw frictionally engages the lug with the bushing and locks the lug in place so that the lug is no longer free to rotate. The grounding connector can be reoriented by loosening the set screw or clamp and rotating the lug to a different orientation.

In the most preferred embodiments, the outer wall of the bushing has a flange and a plurality of flats which define the notch and an inner wall which has a plurality of threads for connecting the bushing to a conduit. Preferably, the lug includes a flexible lip which engages and rotates within the notch. In another embodiment, the outer wall of the bushing has a raised portion that forms a ring around the bushing and the lug has an interior wall with a recessed portion which corresponds to the ring. When the lug is snapped onto the ring, the recessed portion rotatably accommodates the ring and the lug can be freely rotated around the outer circumference of the bushing. In all of the embodiments, the bushing, lug and connector are made from electrically conductive material, preferably malleable iron or aluminum.

In other preferred embodiments, the grounding device includes: a bushing with an outer wall that has a flange, a plurality of flats and a notch, wherein the notch is formed by the flange and the plurality of flats; a lug having a flexible lip, wherein the flexible lip is rotatably accommodated by the notch; and a grounding connector with a set screw, wherein the grounding connector is attached to the lug. The bushing, lug and connector are made from electrically conductive material and a grounding conductor is secured to the bushing by the set screw. The flexible lip engages the bushing when the set screw is tightened and prevents the lug from rotating.

In still another embodiment, the grounding device includes: a first means of attachment, preferably a bushing having an outer wall that includes a plurality of flats, a flange and a notch, wherein the notch is defined by the plurality of flats and the flange; a lug that is rotatably accommodated by the first means of attachment prefereably a lug having a lip, wherein the lip extends upwardly and inwardly and, preferably, is rotatably accommodated by the notch; and a grounding connector with a set screw, wherein the grounding connector is attached to the lug. The bushing is connected to an electrical conduit and a grounding conductor is secured to the bushing by the set screw and electrically contacted to the bushing. In addition, the lip engages the bushing when the set screw is tightened and prevents the lug from rotating.

BRIEF DESCRIPTION OF THE FIGURES

Other objects and many attendant features of this invention will be readily appreciated as the invention becomes better understood by reference to the following detailed description when considered in connection with the accompanying drawings wherein.

DETAILED DESCRIPTION OF THE INVENTION

Figure 1:
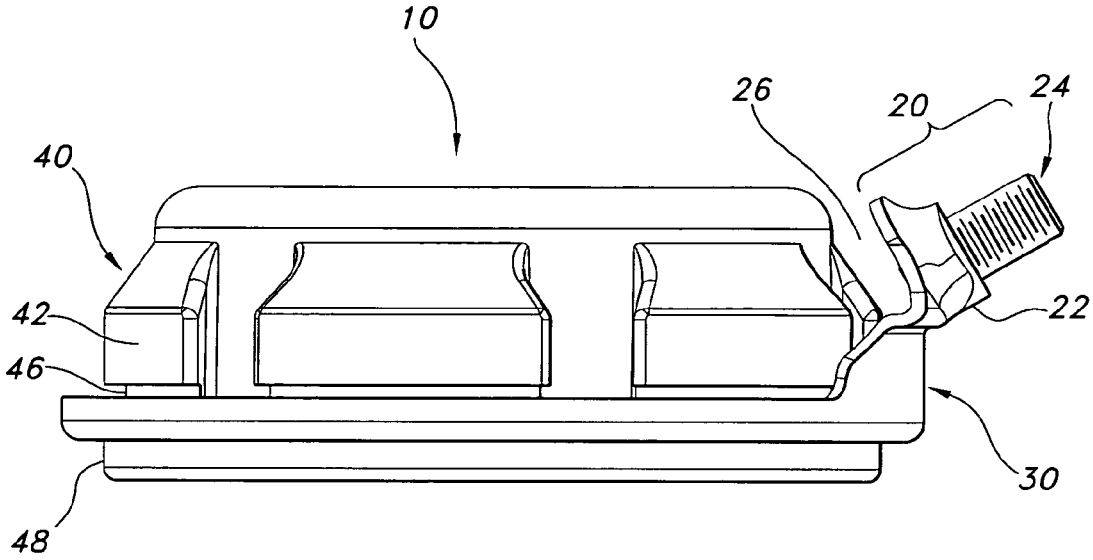
FIG. 1 is a side view of a grounding device showing the bushing, the revolving lug and the connector for the grounding conductor.

The present invention is a grounding device for an electrical conduit that includes a bushing with a lug that freely rotates 360 degrees around the bushing. The grounding connector is attached to the lug and can be easily oriented by rotating the lug. The grounding connector includes a set screw or clamp for attaching a grounding conductor. Once the grounding conductor is installed and the set screw or clamp is tightened, the lug is secured and locked into place. Preferably the bushing includes a first means of attachment and the lug is rotatably accommodated by the first means of attachment.

The lug rotates in a notch or around a ring at the base of the bushing and this allows for 360 degree (unlimited) adjustment of the orientation of the connector on the bushing. This also allows the bushing to be tightly screwed onto the conduit without concern over the final position of the lug or the grounding connector. Once the bushing is in place, the lug is simply rotated to a convenient position and the grounding conductor secured using the set screw or clamp. Along with the convenience, the final installation is more aesthetically pleasing since multiple bushing assemblies are normally installed in a series with all grounding lugs aligned with respect to one another to facilitate connection of the common grounding conductor.

In a preferred embodiment, the set screw or clamp is at a convenient angle (approximately 30–60 degrees from the horizontal axis of the hub) which allows easy screwdriver access for tightening, even when the installation is near an enclosure wall and there is limited space. In addition, the grounding connector can have various configurations so that the angle of the set screw can vary up to 90 degrees. This allows screwdriver access from an angle parallel to the horizontal axis of the hub to an angle perpendicular to the horizontal axis of the hub.

In a preferred embodiment a single set screw allows for faster and easier installation. Typically, similar installations require the removal of the lug, repositioning of the lug, remounting of the lug, and finally installation of the grounding conductor. In contrast, the lug of the present invention is positioned on the bushing and can be freely rotated over 360 degrees. After finger alignment of the lug so that the grounding connector is at the desired orientation, the grounding conductor is placed in the grounding connector and the set screw is tightened. Tightening the set screw not only secures the grounding conductor in the connector, but it also locks the lug into position so that it can no longer freely rotate.

The lug and bushing may be made of any electrically conductive metallic material, preferably malleable iron or aluminum. The screw is made of a metallic material, preferably a stainless steel. In some embodiments of the invention, there may be multiple set screws for large diameter grounding conductors. In other embodiments, there may be a saddle on the set screw for small diameter grounding conductors.

In one embodiment, the outer wall of the bushing has a raised portion around the circumference which forms a ring (not shown in figures). The flexible interior wall of the lug has a recessed portion which corresponds to the ring. The lug is placed on the bushing and then snapped into position over the ring so that the recessed interior wall of the lug accommodates the ring (not shown in figures). Once the lug is snapped onto the ring, it is free to rotate around the circumference of the bushing in the same manner as the embodiments of the invention which use a notch in the outer wall of the bushing. When the set screw or clamp on the lug is tightened, the recessed portion of the interior wall frictionally engages the ring and prevents the lug from freely rotating around the bushing.

Referring now to the drawings, FIG. 1 shows the grounding device 10 of the present invention which includes a bushing 40 with a flange 48 at the base and a plurality of flat surfaces ("flats") 42 for tightening with a wrench, a lug 30 which fits over the bushing 40 and a grounding connector assembly 20 which is attached to the lug 30. The flats 42 extend outwardly from the curved, exterior side wall 41 of the bushing 40. A notch 46 extends circumferentially around the bushing 40 and is defined by the bottom of the flats 42 and the flange 48. When the grounding device 10 is assembled, the lug 30 circumferentially engages the notch 46.

The grounding connector assembly 20 includes a connector 22 and a set screw 24. In some embodiments, more than one connector assembly 20 can be used to maintain the grounding conductor 90 (see FIGS. 3 and 5) in electrical contact with the bushing 40. The connector 22 is configured so that it forms a slot or an opening 26 between the connector 22 and the bushing 40. The configuration of the connector 22 can be varied to accommodate different size conductors 90.

Figure 2:
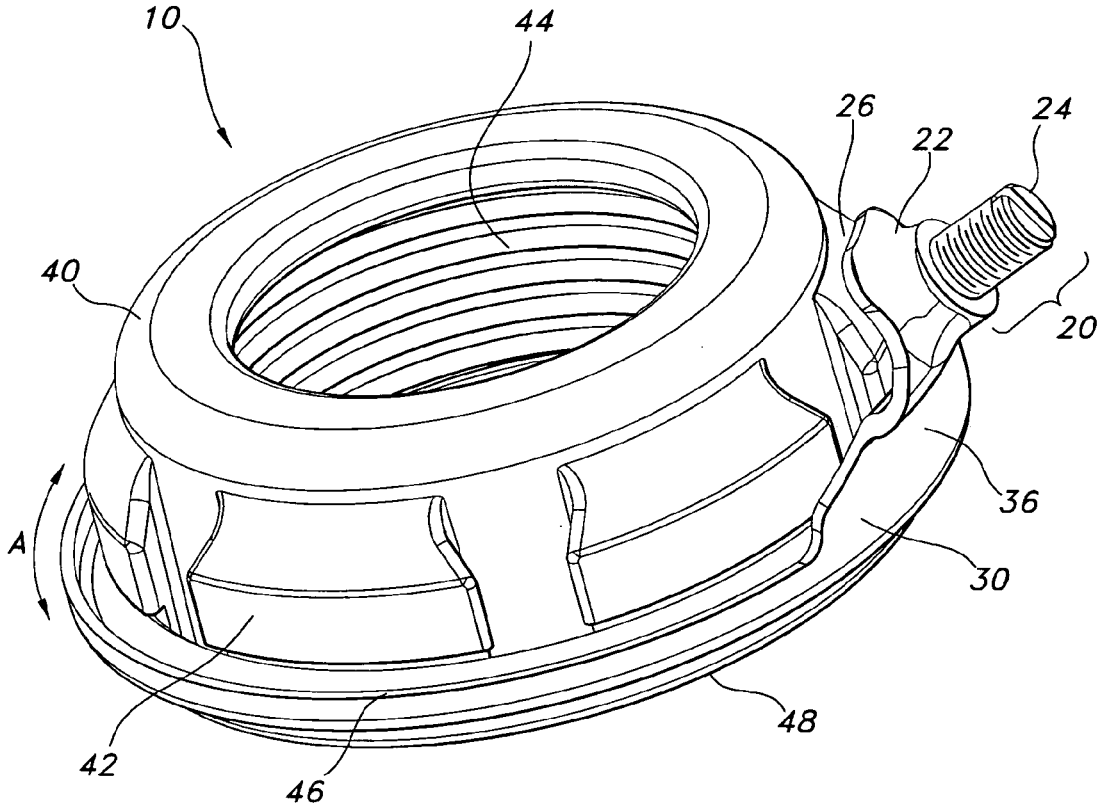
FIG. 2 is a perspective view of a grounding device showing the bushing, the revolving lug and the connector for the grounding conductor.

FIG. 2 shows a perspective view of the grounding device 10 and the bushing 40 which includes internal threads 44 for connecting the bushing 40 to a conduit (not shown). The lug 30 freely rotates in the notch 46 of the bushing 40 (as indicated by the bi-directional arrow A in FIG. 2) so that the connector assembly 20 can be positioned at any location on the bushing 40 over a 360 degree range. This allows the bushing 40 to be tightly secured to the conduit without restricting the orientation of the lug 30 and connector assembly 20. Thus, a user can easily position the connector 20 in the most convenient and accessible location for connecting a grounding conductor 90 (see FIGS. 3 and 5).

Figure 3:
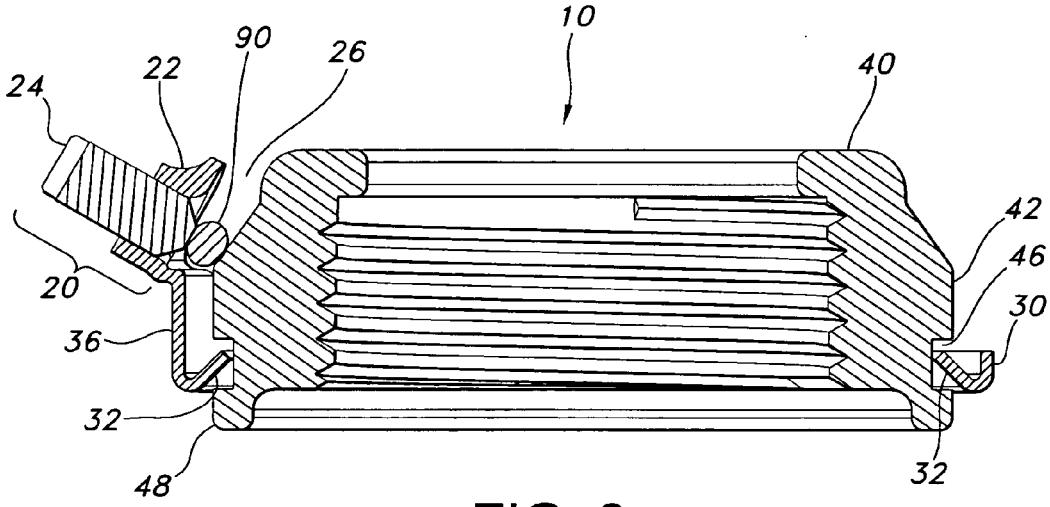
FIG. 3 is a sectional view of a grounding device showing the bushing, the revolving lug and the connector for the grounding conductor.

FIG. 3 is a sectional view of the grounding device 10 and shows details of the lug 30. The lower portion of the lug 30 extends upwardly and inwardly to form a flexible lip 32 which engages the notch 46 in the bushing 40. The lug 30 is attached to the bushing 40 by positioning it onto the bushing 40 and moving it downwardly. The lug 30 is sized so that the lip 32 flexes to permit the lug 30 to pass over the flats 42 of the bushing 40. After the lip 32 passes over the flats 42 to the notch 46 in the bushing 40, the lip 32 returns to its original position and rotatably engages the notch 46.

The connector assembly 20 is attached to the lug 30 and includes a connector 22 for receiving a grounding conductor 90 and a set screw 24 for securing the grounding conductor 90. The connector assembly 20 extends upwardly and outwardly from the lug 30 to form a slot 26 between the connector 22 and the bushing 40. The distance that the connector assembly 20 extends upwardly and outwardly from the lug 30 can vary in order to accommodate different size grounding connectors 90. A grounding conductor 90 is inserted in the slot 26 and the set screw 24 is tightened to secure the grounding conductor 90 in place. The tightening of the set screw 24 to secure the grounding conductor 90 forces the connector assembly 20 away from the bushing 40 and, at the same time, causes the lip 32 on the opposite side of the lug 30 to frictionally engage the notch 46. This prevents the lug 30 from freely rotating in the notch 46 and locks the lug 30 and connector assembly 20 in a fixed position on the bushing 40.

Figure 4:
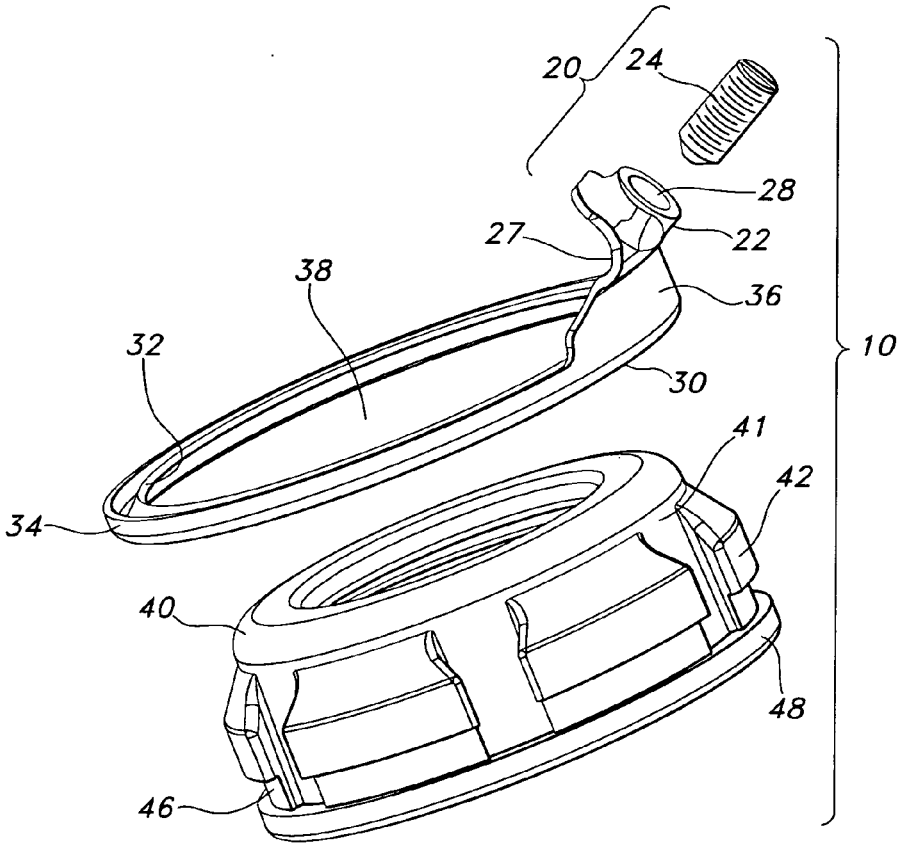
FIG. 4 is an exploded view of a grounding device showing the bushing, the revolving lug and the connector for the grounding conductor.

FIG. 4 shows an exploded perspective view of the grounding assembly 10 and shows a detailed view of the components. The lug 30 is formed by a continuous, curved outer side wall 34 which defines an aperture 38. The side wall 34 extends inwardly and upwardly at its base to form an interior lip 32. The lug 30 also has an extended portion 36 of the side wall 34 which attaches to the connector assembly 20. The connector assembly 20 includes a connector 22 having a threaded aperture 28 for receiving the set screw 24. The connector assembly 20 also includes a base section 27 which connects the extended portion 36 of the side wall 34 and the connector 22. In embodiments intended for use with large size conductors, the distance that the base section 27 extends outwardly is increased in order to form a larger slot 26.

FIG. 4 illustrates how the bushing 40 has a plurality of flats 42 which extend outwardly from the exterior side wall 41 of the bushing 40. When the bushing 40 is connected to a conduit (not shown), the flats 42 are engaged by a wrench to tighten the connection of the bushing 40 to the conduit. Preferably, the bushing 40 has six or eight flats 42 and the distance between the flats 42 on opposing sides of the bushing 40 correspond to standard wrench sizes. The base of the bushing 40 is formed by a flange 48 which extends outwardly from the side wall 41 approximately the same distance as the flats 42. A continuous notch 46 is formed between the flats 42 and the flange 48 around the circumference of the bushing 40.

In preferred embodiments, more than one connector assembly 20 can be attached to the lug 30 to more securely connect a single grounding conductor 90 or to connect a plurality of grounding conductors. The connector assembly 20 can also have various configurations in order to accommodate grounding conductors 90 having a wide range of sizes. For example, for a large grounding conductor 90, the base section 27 of the connector assembly 20 extends further from the extended portion 36 of the side wall 34 so that the distance between the connector 22 and the bushing 40 is greater and the slot 26 is larger.

Figure 5:
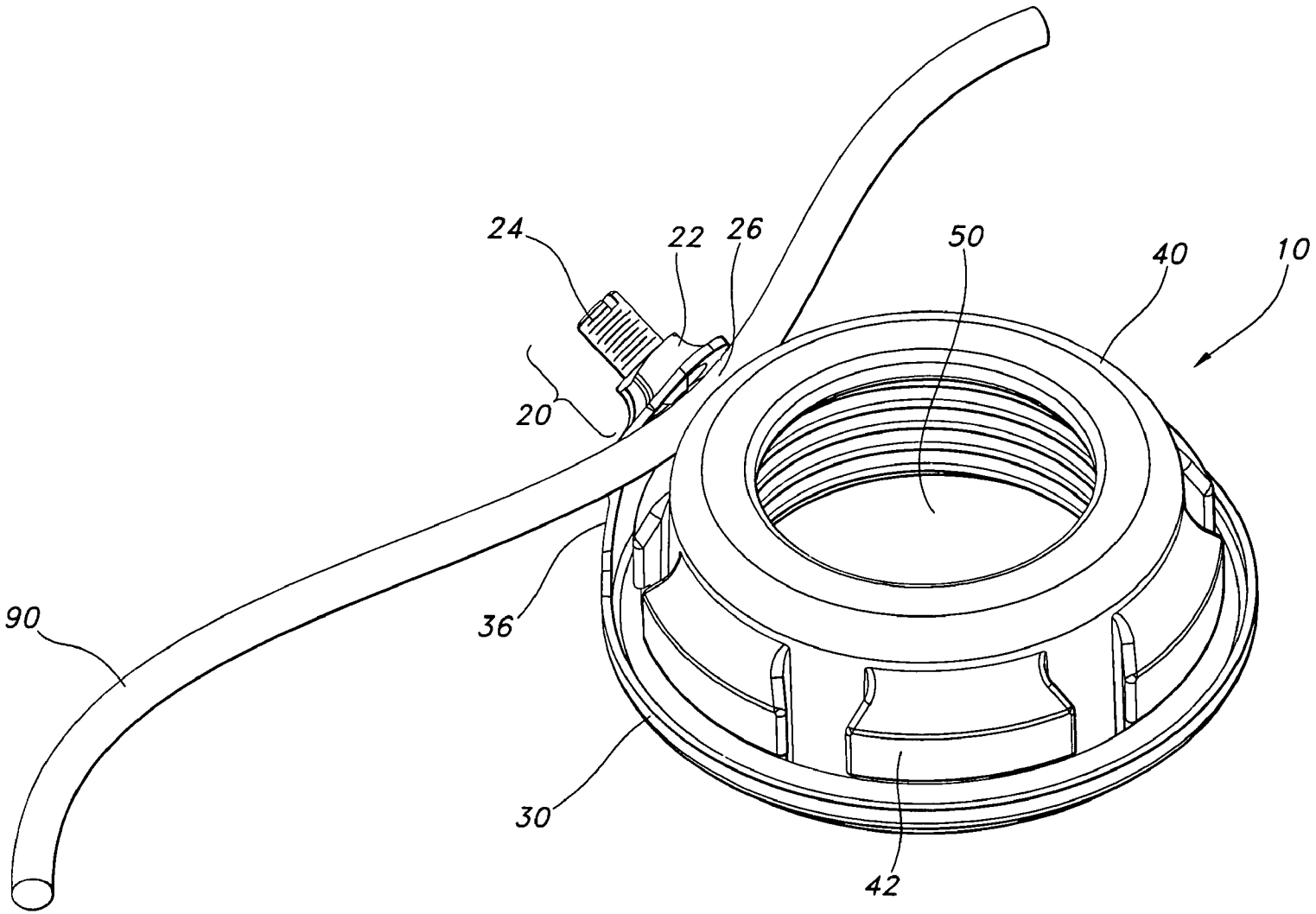
FIG. 5 is a perspective view of an assembled grounding device showing the bushing, the revolving lug and the connector for the grounding conductor.

FIG. 5 shows a perspective view of an assembled embodiment of the grounding device 10 of the present invention. When the lug 30 is fitted onto the bushing 40 and the lip 32 engages the notch 46 of the bushing 40 (see FIG. 4), a slot 26 is formed between the connector 22 and the bushing 40. The grounding conductor 90 is inserted into the slot 26 and the set screw 24 is tightened to secure the grounding conductor 90 in place. The tightening of the set screw 24 causes the portion of the lip 32 opposite the connector assembly 20 to frictionally engage the notch 46. When the set screw 24 is securely tightened, the lug 30 is locked into position and cannot freely rotate in the notch 46. If it becomes necessary to change the position of the connector assembly 20, the set screw 24 is loosened and the lug 30 can be freely rotated to a new position.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A grounding device for an electrical conduit comprising:

a bushing comprising an outer wall;

a lug rotatably accommodated by the bushing; and a grounding connector attached to the lug, wherein the grounding connector comprises a set screw or a clamp, wherein a grounding conductor is electrically contacted to the bushing by the grounding connector and wherein the force exerted by the set screw or clamp frictionally engages the lug with the bushing and locks the lug in place so that the lug is no longer free to rotate.

2. The grounding device for an electrical conduit according to claim 1, wherein the grounding connector is reoriented by loosening the set screw or clamp and rotating the lug to a different orientation.

3. The grounding device for an electrical conduit according to claim 1, wherein the outer wall of the bushing comprises a notch or a ring.

4. The grounding device for an electrical conduit according to claim 3, wherein the outer wall of the bushing comprises a flange and a plurality of flats.

5. The grounding device for an electrical conduit according to claim 4, wherein the notch is defined by the flange and the plurality of flats.

6. The grounding device for an electrical conduit according to claim 1, wherein the bushing, lug and connector are made from electrically conductive material.

7. The grounding device for an electrical conduit according to claim 3, wherein the lug comprises a flexible lip, and wherein the flexible lip engages the notch.

8. A grounding device for an electrical conduit comprising:

a bushing comprising an outer wall;

a lug rotatably accommodated by the bushing; and a grounding connector attached to the lug, wherein a grounding conductor is electrically contacted to the bushing by the grounding connector, wherein the outer wall of the bushing comprises a notch or a ring and wherein the lug comprises an interior wall with a recessed portion, wherein the recessed portion accommodates the ring.

9. A grounding device for an electrical conduit comprising:

a bushing comprising a first means of attachment;

a lug rotatably accommodated by the first means of attachment; and a grounding connector attached to the lug, wherein the grounding connector comprises a set screw or a clamp and wherein the force exerted by the set screw or clamp frictionally engages the lug with the bushing and locks the lug in place so that the lug is no longer free to rotate, wherein the bushing, lug and connector are made from electrically conductive material, and wherein a grounding conductor is electrically contacted to the bushing by the grounding connector.

10. The grounding device for an electrical conduit according to claim 9, wherein the grounding connector is reoriented by loosening the set screw or clamp and rotating the lug to a different orientation.

11. A grounding device for an electrical conduit comprising:

a bushing comprising an outer wall comprising a flange, a plurality of flats and a notch, wherein the notch is formed by the flange and the plurality of flats;

a lug comprising a flexible lip, wherein the flexible lip is rotatably accommodated by the notch; and a grounding connector comprising a set screw or a clamp, wherein the grounding connector is attached to the lug, wherein the bushing, lug and connector are made from electrically conductive material, and wherein a grounding conductor is secured in place and electrically contacted to the bushing by the set screw or the clamp.

12. The grounding device for an electrical conduit according to claim 11, wherein the lip extends upwardly and inwardly.

13. The grounding device for an electrical conduit according to claim 11, wherein the flexible lip engages the bushing when the set screw or clamp is tightened and prevents the lug from rotating.

* * * * *